US006598396B2

(12) United States Patent
Bailey

(10) Patent No.: US 6,598,396 B2
(45) Date of Patent: Jul. 29, 2003

(54) INTERNAL COMBUSTION ENGINE EGR SYSTEM UTILIZING STATIONARY REGENERATORS IN A PISTON PUMPED BOOST COOLED ARRANGEMENT

(75) Inventor: Brett M. Bailey, Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/990,620

(22) Filed: Nov. 16, 2001

(65) Prior Publication Data

US 2003/0093994 A1 May 22, 2003

(51) Int. Cl.[7] ..... F02B 33/44

(52) U.S. Cl. ..... 60/605.2; 423/568.12; 423/568.29; 60/278

(58) Field of Search ..... 60/605.2, 278, 60/280, 301; 123/568.17, 568.11, 568.12, 568.14, 568.16, 568.18, 2, 568.26, 568.29

(56) References Cited

U.S. PATENT DOCUMENTS

| | | | | | |
|---|---|---|---|---|---|
| 5,509,394 | A | * | 4/1996 | Hitomi et al. | 123/568.12 |
| 5,771,868 | A | * | 6/1998 | Khair | 60/605.2 |
| 5,802,846 | A | | 9/1998 | Bailey | 60/605.2 |
| 5,806,308 | A | * | 9/1998 | Khair et al. | 60/605.2 |
| 5,927,075 | A | * | 7/1999 | Khair | 60/605.2 |
| 6,009,709 | A | * | 1/2000 | Bailey | 60/605.2 |
| 6,062,026 | A | * | 5/2000 | Woollenweber et al. | 60/605.2 |
| 6,138,649 | A | * | 10/2000 | Khair et al. | 123/568.12 |
| 6,138,650 | A | * | 10/2000 | Bailey | 123/568.12 |
| 6,301,887 | B1 | * | 10/2001 | Gorel et al. | 60/605.2 |
| 6,351,946 | B1 | * | 3/2002 | Faletti | 60/605.2 |
| 6,367,256 | B1 | * | 4/2002 | McKee | 60/605.2 |
| 6,408,833 | B1 | * | 6/2002 | Faletti | 60/605.2 |
| 6,422,220 | B1 | * | 7/2002 | Lepp et al. | 123/568.12 |
| 6,427,436 | B1 | * | 8/2002 | Allansson et al. | 60/605.2 |
| 6,474,060 | B2 | * | 11/2002 | Khair | 60/278 |
| 2002/0078935 | A1 | * | 6/2002 | Opris | 60/605.2 |
| 2002/0124553 | A1 | * | 9/2002 | Lucas et al. | 60/278 |

FOREIGN PATENT DOCUMENTS

| | | | | |
|---|---|---|---|---|
| JP | 359101519 | A | * 6/1984 | 60/278 |
| JP | 405071428 | A | * 3/1993 | 60/605.2 |
| JP | 406066208 | A | * 3/1994 | 123/568.29 |
| JP | 407054718 | A | * 2/1995 | |
| JP | 407259654 | A | * 10/1995 | |
| JP | 409088569 | A | * 3/1997 | |
| JP | 410238414 | A | * 9/1998 | |
| JP | 2001140702 | A | * 5/2001 | |

* cited by examiner

*Primary Examiner*—Thomas Denion
*Assistant Examiner*—Thai-Ba Trieu
(74) *Attorney, Agent, or Firm*—Jenkens & Gilchrist

(57) ABSTRACT

A piston-pumped EGR system for an internal combustion engine includes first and second stationary regenerators. Alternating flow through the first and second stationary regenerators is controlled by a regenerator directional flow control valve in fluid communication with at least one check valve disposed between the regenerator directional flow control valve and an exhaust manifold of the engine. Flow through the stationary recuperators is controlled so that exhaust gas and cooling bleed flow are alternatingly directed through the stationary recuperators whereby heat is removed from the recirculated exhaust gas prior to reintroduction into an intake manifold and one of the stationary regenerators is cooled by bleed air, which is subsequently discharged into the exhaust manifold of the engine.

20 Claims, 1 Drawing Sheet

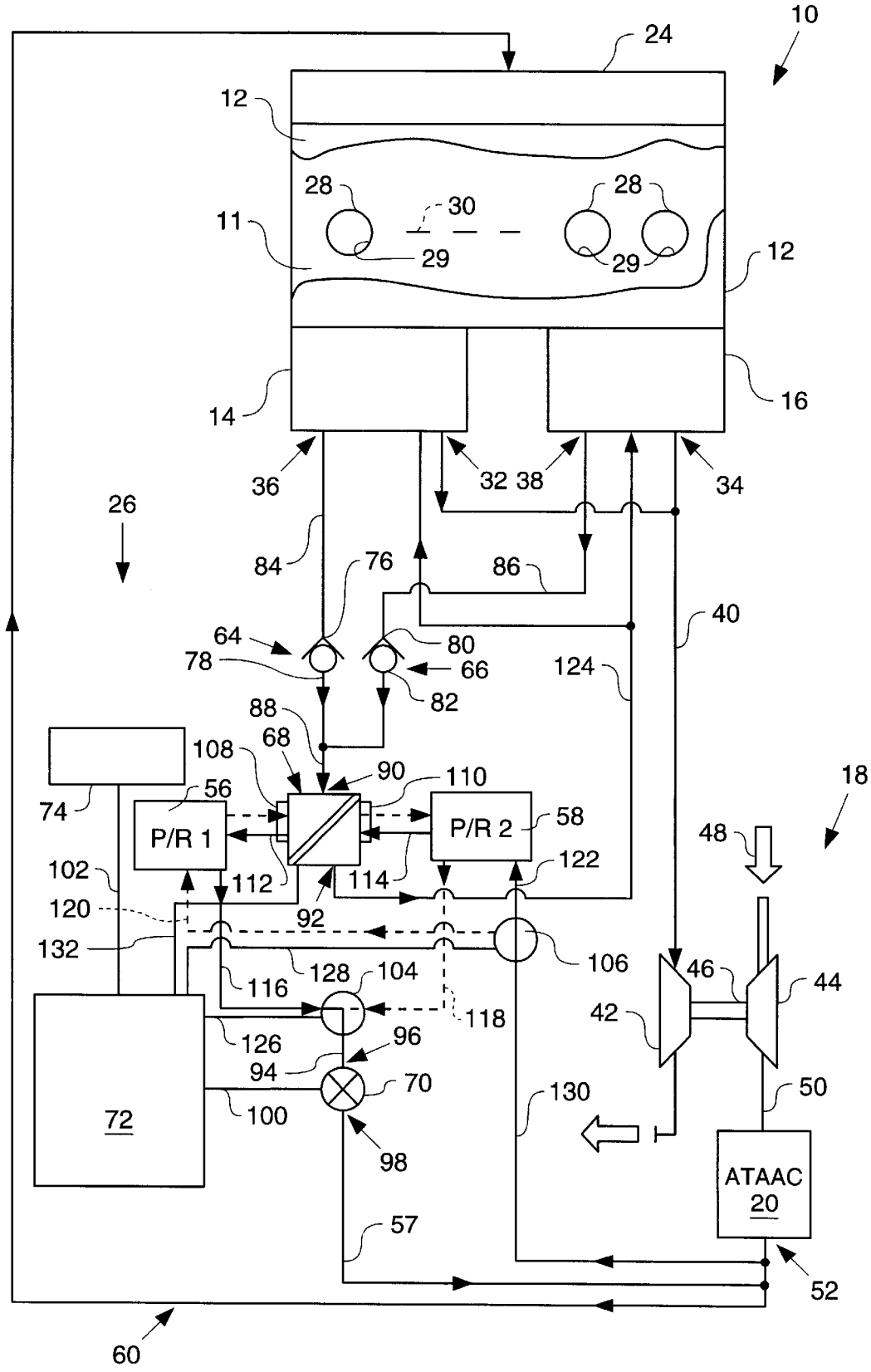
10
24
12
28
30
28
11
29
29
12
14
16
36
32 38
34
26
84
76
86
40
64
80
78
66
124
82
88
68
108
90
110
18
74
56
P/R 1
P/R 2
58
48
102
112
114
122
120
92
132
106
128
104
46
44
116
118
42
126
96
94
70
130
50
72
100
98
ATAAC
20
57
52
60

INTERNAL COMBUSTION ENGINE EGR SYSTEM UTILIZING STATIONARY REGENERATORS IN A PISTON PUMPED BOOST COOLED ARRANGEMENT

TECHNICAL FIELD

This invention relates generally to internal combustion engines, and more particularly to exhaust gas recirculation systems in such engines.

BACKGROUND

An exhaust gas recirculation (EGR) system is used for controlling the generation of undesirable pollutant gases and particulate matter in the operation of internal combustion engines. Such systems have proven particularly useful in internal combustion engines used in motor vehicles such as passenger cars, light duty trucks, and other on-road motor equipment.

EGR systems primarily recirculate exhaust gas by-products into the intake air supply of the internal combustion engine. The exhaust gas which is reintroduced to the engine cylinder reduces the concentration of oxygen therein, which in turn lowers the maximum combustion temperature within the cylinder and slows the chemical reaction of the combustion process, decreasing the formation of nitrous oxides ($NO_x$). Furthermore, the exhaust gases typically contain unburned hydrocarbons which are burned on reintroduction into the engine cylinder, further reducing the emission of exhaust gas byproducts which would be emitted as undesirable pollutants from the internal combustion engine.

Some internal combustion engines include turbochargers to increase engine performance and are available in a variety of configurations. When utilizing EGR in a turbocharged diesel engine, the exhaust gas to be recirculated is preferably removed upstream of the exhaust gas driven turbine associated with the turbocharger. In many EGR applications, the exhaust gas is diverted by a poppet-type EGR valve directly from the exhaust manifold. The percentage of the total exhaust flow which is diverted for reintroduction into the intake manifold of an internal combustion engine is known as the EGR rate of the engine.

The recirculated exhaust gas is preferably introduced to the intake airstream downstream of the compressor and air-to-air aftercooler (ATAAC). Introducing the exhaust gas downstream of the compressor and ATAAC is preferred in some systems due to reliability and maintainability concerns that arise if the exhaust gas passes through the compressor and ATAAC. An example of such an EGR system is disclosed in U.S. Pat. No. 5,802,846 issued to Brett M. Bailey, the inventor of the present invention, on Sep. 8, 1998, and assigned to the assignee of the present invention.

The reintroduction of exhaust gases will occur naturally when the exhaust manifold pressure is higher than the turbocharger boost pressure. However, when such a turbocharged engine operates under low speed and high torque conditions, the boost pressure is typically higher than the exhaust manifold pressure and recirculation of the exhaust gases is not possible. Early approaches to address this problem have included using devices such as back pressure valves, restrictive turbines, throttle valves, and venturi inlet systems. Each can be used to improve the back pressure to boost pressure gradient to some degree, but each approach results in increased fuel consumption.

A problem with any EGR system is to inject the right amount of EGR across the operating range of the engine. If too much EGR is added, the air/fuel ratio will drop into the high teens, producing considerable particulate emissions. Relatively expensive devices, such as air mass flow sensors, are generally required to determine the amount of EGR. These devices add additional expense to the cost of the engine and an increased chance of system failure considering the high number of miles and hours that on-road vehicles, particularly diesel powered vehicles, operate. If the EGR rate can be controlled, the next problem is in cooling the exhaust to allow the most EGR dilutent in the inlet charge. If the cooling is accomplished by a jacket water cooler, all of the thermal energy of the EGR is transmitted into the engine's cooling system, which is already stressed by the increased rejection resulting from the higher charge temperatures caused by the EGR. Thus, the high temperatures and corrosiveness of exhaust gases flowing through the EGR line make the job of cooling the exhaust very difficult. High temperatures, and worse yet, high thermal gradients, make the job of sealing the multitude of pipes and passages of the heat exchangers next to impossible for long-term reliability and durability.

Previous methods of cooling the EGR involve a heat exchanger, for example the aforementioned jacket water cooler, to reduce the temperature of the EGR. Typical heat exchangers allow soot to build up inside the cooler, thereby increasing the pressure drop across the cooler. The engine has no ability to overcome or clear the barrier of soot forming within the passages. As the passages become clogged, there will be less and less EGR flowing into the intake manifold of the engine unless sophisticated computer controls and sensors are used to determine a change in air flow through the engine, or other determination of engine performance. Also, the exhaust of a diesel engine, in particular, contains particulate matter or soot that can build up on surfaces. The particulate matter or soot typically contains sulfuric acid that is highly corrosive to many metals. Thus, the EGR path must be made of materials that are corrosion resistant so as to keep leaks from forming. The material of choice has been stainless steel, which is significantly more expensive than steel or cast iron.

The present invention is directed to overcoming one or more of the problems set forth above.

SUMMARY OF THE INVENTION

In accordance with one aspect of the present invention, an internal combustion engine includes a block having at least one combustion chamber defined therein, an intake manifold in fluid communication with the combustion chamber, and a first exhaust manifold fluidly connected to the combustion chamber for transporting exhaust gas therefrom to at least one of a first primary exhaust outlet and a first EGR exhaust outlet. The engine further includes a first check valve having an inlet fluidly coupled to the first EGR exhaust outlet, a regenerator directional control valve having an inlet ports, first and second bidirectional flow ports and a bleed air discharge port. The inlet port is in fluid communication with the outlet of the check valve. The engine further includes first and second stationary regenerators, each having a first end and a second end. The first ends of the stationary regenerators are in fluid communication with a respective one of the bidirectional flow ports of the regenerator directional flow control valve. The second ends of the stationary regenerators are in selective communication with either the intake manifold of the engine or said bleed flow line that is in fluid communication with the intake manifold.

In another aspect of the present invention, an EGR system for an internal combustion engine which has a block defining a plurality of combustion chambers, an intake manifold, and an exhaust manifold arranged for transporting exhaust gas from at least one of the combustion chambers through at least one of a first primary exhaust outlet and a first EGR exhaust outlet. The EGR system includes a first check valve having an inlet fluidly coupled to the first EGR exhaust outlet of the exhaust manifold, and a regenerator directional flow control valve having an inlet port, first and second bidirectional flow ports, and a bleed air discharge port. The inlet port of the regenerator directional flow control valve is in fluid communication with the outlet of the check valve. The engine further includes first and second stationary regenerators, each having a first end and a second end. The first ends of the stationary regenerators are in respective fluid communication with one of the bidirectional flow ports of the regenerator directional flow control valve. The second ends of the stationary generators are in selective communication with either the intake manifold of the engine or said bleed flow line that is in fluid communication with the intake manifold.

Yet another aspect of the present invention includes a method for using an EGR system with an internal combustion engine. The internal combustion engine has a plurality of combustion chambers, an intake manifold, and an exhaust manifold, and the EGR system includes a check valve having an inlet end fluidly coupled to an EGR exhaust outlet of the exhaust manifold of the engine, a regenerator directional flow control valve, and first and second stationary regenerators. The method includes the steps of operating the EGR system in first and second modes in response to selective positioning of the regenerator directional flow control valve. Operating the EGR system in the first mode includes selectively moving the regenerator directional flow control valve to a first position whereby exhaust gas discharged through the EGR exhaust outlet of the exhaust manifold is directed to the first stationary regenerator, whereupon the temperature of the recirculated exhaust gas is reduced and then introduced into a conduit in communication with the intake manifold of the engine. Simultaneously, bleed air from the conduit in fluid communication with the intake manifold is directed through the second stationary regenerator, thereby cooling the second recuperator, then directed through the regenerator directional flow control valve to the exhaust manifold of the engine. Subsequently, the EGR system is operated in the second mode in response to moving the regenerator directional flow control valve to a second position, whereupon recirculated exhaust gas received from the EGR exhaust outlet of the exhaust manifold is directed by the regenerator directional flow control valve to the second stationary recuperator and then, after being cooled during passage through the second regenerator, is directed to the conduit in fluid communication with the intake manifold. Simultaneously during the second mode operation, bleed air from the conduit in fluid communication with the intake manifold is directed through the first stationary recuperator, thereby cooling the first stationary recuperator, and thence directed by the regenerator directional flow control valve to the exhaust manifold of the engine.

BRIEF DESCRIPTION OF THE DRAWINGS

The sole FIGURE, FIG. 1, is a schematic illustration of an embodiment of an internal combustion engine of the present invention.

DETAILED DESCRIPTION

Referring now to the sole FIGURE, there is shown a schematic representation of an embodiment of an internal combustion engine 10 of the present invention. The internal combustion engine 10 generally includes a block 11, a cylinder head 12, a first exhaust manifold 14, a second exhaust manifold 16, a turbocharger 18, an air-to-air after cooler (ATAAC) 20, an intake manifold 24, and an EGR system 26 embodying another aspect of the present invention.

The engine block 11 defines a plurality of combustion chambers 29. The exact number of combustion chambers 29 may be selected depending upon a specific application, as indicated by dashed line 30. For example, block may include 6, 10, or 12 combustion chambers 29. Each combustion cylinder 28 has a displacement volume which is the volumetric change within the combustion cylinder as an associated piston (not shown) moves from a bottom dead center to a top dead center position, or vice versa. The displacement volume may be selected depending upon the specific application of the internal combustion engine 10. The sum of the displacement volumes of each of the combustion cylinder cylinders 28 define a total displacement volume for the internal combustion engine 10.

A cylinder head 12 is connected to the block 11 in a manner known to those skilled in the art, and is shown with a section broken away to expose the block 11. As each of the pistons moves to its respective top dead center position, each piston and the cylinder head 12 cooperate with a respective cylinder 28 defined in the block 11 to define a combustion chamber 29 therebetween. In the embodiment shown, the cylinder head 12 is a single cylinder head and includes a plurality of exhaust valves (not shown). Exhaust manifolds 14, 16 and intake manifold 24 are connected to the cylinder head 12.

Exhaust manifolds 14, 16 have cylinder ports fluidly connected to receive combustion products from the combustion chambers 29, and each includes a primary exhaust outlet 32 and 34, respectively, and an EGR exhaust outlet 36 and 38, respectively. Connected to the primary exhaust outlets 32 and 34 is a respective portion of a Y-conduit 40, which in turn transports the combustion products to a turbocharger 18.

The turbocharger 18 includes a turbine section 42 and a compressor section 44. The turbine section 42 is driven by the exhaust gases which flow from the primary exhaust outlets 32 and 34 of the exhaust manifolds 14, 16. The turbine section 42 is coupled with the compressor 44 via a shaft 46 and thereby rotatably drives the compressor 44.

The compressor 44 receives combustion air from the ambient environment (as indicated by arrow 48) and provides compressed combustion air via the fluid conduit 50 to the ATAAC 20.

The ATAAC 20 receives the compressed combustion air from the compressor 44 by way of the fluid conduit 50 and cools the combustion air. In general, the ATAAC 20 is a heat exchanger having one or more fluid passageways through which the compressed combustion air flows. Cooling air flows around the fluid passageways to cool the combustion air transported through the passageways. The cooled combustion air is transported from the ATAAC 20 through an outlet 52 and thence through a conduit 60 to the intake manifold 24. As described below in greater detail, recirculated exhaust gas is also introduced into the conduit 60. Thus, the intake manifold 24 provides a mixture of charged combustion air and exhaust gas to the individual combustion chambers 29.

The EGR system 26 includes a first check valve 64, a second check valve 66, a regenerator directional flow control valve 68, a first stationary regenerator 56, a second stationary regenerator 58, an EGR system controller 72, and a sensor 74. The first and second stationary regenerators 56, 58 desirably have a particulate trap associated therewith to trap particulate emissions present in the exhaust gas stream. The first stationary regenerator 56 is identified in the schematic representation as P/R 1 (particulate trap/recuperator 1) and the second stationary recuperator 58 is identified in the schematic representation as P/R 2 (particulate trap/recuperator 2). The system further includes a regenerator outlet flow valve 104 and a bleed air directional flow control valve 106.

The first check valve 64 includes an EGR inlet 76 and an EGR outlet 78. The second check valve 66 includes an EGR inlet 80 and an EGR outlet 82. The EGR outlet 76 is coupled to the EGR exhaust outlet 36 by a fluid conduit 84 and the EGR inlet 80 is coupled to the EGR exhaust outlet 38 by a fluid conduit 86. A Y-conduit 88 is respectively connected at its Y-end to the EGR outlets 78, 82, and is connected at its single end to an inlet port 90 of the regenerator directional flow control valve 68.

The regenerator directional flow control valve 68 has an inlet port 90, first and second bidirectional flow control ports 108, 110, and a bleed air discharge port 92.

In a preferred embodiment of the present invention, the first and second particulate trap/stationary recuperators 56, 58 are formed of a ceramic material having a plurality of small internal passageways. The ceramic bodies of the recuperators act as thermal storage devices which, as explained below in greater detail, can alternatingly cool the exhaust gas transported through the passageways, and then be cooled when operating in a second mode by a reverse flow of bleed air through the passageways of the recuperator. By way of example, a first mode of directed exhaust gas and bleed air flow is represented by solid lines and a second, alternating mode, illustrated by dashed lines where applicable.

In an illustrative first operating mode, exhaust gas directed to the inlet port 90 of the regenerator directional flow control valve 68 is directed through the first bidirectional flow port 108 of the regenerator directional flow control valve 68 to the first end of the first particulate trap/stationary recuperator 56 whereupon the exhaust gas is cooled during passage through the particulate trap/stationary recuperator 56. The cooled exhaust gas is then transported from the second end of the first particulate trap/stationary recuperator 56 through said fluid conduit 116 to the regenerator outlet flow valve 104, thence through a fluid conduit 94 to an inlet 96 of a metering valve 70. An outlet 98 of the metering valve 70 is coupled to a fluid conduit 57 connected to the conduit 60 extending between the ATAAC 20 and the intake manifold 24 of the engine 10. Desirably, the connection between the fluid conduit 57 and the conduit 60 is downstream of the ATAAC 20. A bleed air conduit 130 is also connected to the conduit 60, extending between the ATAAC 20 and the intake manifold 24, at a position immediately downstream of the ATAAC 20 and extends between the conduit 60 and a bleed air directional flow control valve 106. In the first operating mode, bleed air is directed by the bleed air directional flow valve 106 to the second end of the second particulate trap/stationary recuperator 58. The bleed air flows through the internal passageways of the recuperator 58 in a reverse flow path from the second end to a first end, whereupon it is discharged through a fluid conduit 114 in communication with a second bidirectional flow port 110 of the regenerator directional flow control valve 68. The bleed air then is directed by the regenerator control valve 68 through the discharge port 92 and into a Y-conduit 124 which is in communication with the first and second exhaust manifolds 14, 16.

After a preselected time of operation in the first mode, the regenerator directional flow control valve 68 is moved to a second position whereat the EGR system operates in a second, or reverse, operating mode. In the illustrative second, or reverse, operating mode, hot exhaust gas received through the inlet port 90 of the regenerator directional flow control valve 68 is directed by the valve 68 to the second bidirectional flow port 110, thence through the conduit 114 into the first end of the second particulate trap/stationary regenerator 58, whereupon the exhaust gas is cooled and then discharged through a fluid conduit 118 to the regenerator outlet flow valve 104. The regenerator outlet flow control valve 104 then directs the cooled exhaust gas through the fluid conduit 94, the metering valve 70, and thence into the fluid conduit 57 in communication with the conduit 60, which is in communication with the intake manifold 24. In the second, or alternative operating mode, the bleed air is directed from the bleed air conduit 130 to a fluid conduit 120 in communication with the second end of the first particulate trap/stationary recuperator 56. The bleed air then cools the inner passageways of the stationary recuperator 56, and is then conducted from the first end of the particulate trap/stationary recuperator 56 through the conduit 112 to the first bidirectional flow port 108 of the regenerator directional flow control valve 68. The regenerator directional flow control valve 68 then directs the bleed air through the discharge port 92 of the valve 68, through the Y-conduit 124, and subsequently into the exhaust manifolds 14 and 16 as described above.

The EGR controller 72 provides control outputs by way of conductor 100 to the metering valve 70, conductor 126 to the regenerator outlet flow valve 104, conductor 132 to the regenerator directional flow control valve 68, and conductor 128 to the bleed air directional flow control valve 106. The EGR controller 72 receives a sensor input signal from sensor 74 by way of a conductor 102. Sensor 74 is adapted, for example, to monitor the status of one or more of: the $CO_2$ content of the exhaust gas, the $NO_x$ content of the exhaust gas, the EGR air flow rate, engine speed, and altitude. If desired, other sensors, such as pressure sensors in one or more of the EGR exhaust flow lines 116, 94, and/or 57, and in the bleed air flow lines 130, 120, 122, and 124, if so desired. Preferably, the EGR controller 72 includes a microprocessor and associated memory (not shown) which affect the generation of appropriate control signals for use in controlling the regenerator directional flow control valve 68, metering valve 70, the regenerator outlet flow valve 104, and the bleed air directional flow control valve 106, based upon output signals received from the sensor 74 and/or other sensors as may be advantageously applied. Preferably, the metering valve 70 is a proportional valve.

INDUSTRIAL APPLICABILITY

During operation, check valves 64, 66 permit fluid flow only from their respective inputs 76, 80 to their respective outputs 78, 82, and thus prohibit back flow of gases into the exhaust manifolds 14, 16 when the pressure at the EGR outlets 78, 82 exceed the pressure at the EGR inlets 76, 80, respectively. Even though the average exhaust pressure is lower than the boost pressure, i.e., the intake air pressure in fluid conduit 60 extending between the ATAAC 20 and the intake manifold 24, there are events during the engine cycle when the exhaust pressure is greater than the boost pressure. In a piston-pumped EGR system, these events are referred to as exhaust pressure pulses. As an alternative, the fluid flow can be from either the first exhaust manifold 14 or the second exhaust manifold 16 verses from both exhaust manifolds 14,16 without changing the jest of the EGR system.

The exhaust pressure pulses occur when an exhaust valve opens and the blow down process quickly fills a respective exhaust manifold 14, 16. Since the turbocharger 18 cannot accept all the exhaust flow, the pressure in the exhaust manifold builds, and is thus referred to as a piston pumped EGR system. After the blow down process, the turbocharger 18 can accept the entire flow from the exhaust manifold, and the exhaust manifold pressure drops. These exhaust pressure pulses are especially prevalent in engine designs such as in truck engines where the volume of the exhaust manifold is relatively small, i.e., the smaller the exhaust manifold volume, the greater the exhaust pressure pulse.

Check valves 64, 66 take advantage of the pressure pulse events by permitting exhaust gas recirculation through the intake manifold 24 during exhaust pressure pulses, and prevent back flow during periods when boost pressure exceeds exhaust manifold pressure. Preferably, the opening pressure of check valves 64, 66 is adjustable to permit individual tuning of the check valves 64, 66 to a respective predetermined pressure level. The regenerator directional flow control valve 68 receives the piston pumped exhaust gases passing through check valves 64, 68, and carries out a two-step process of first diverting the exhaust gas through one of the bidirectional flow ports 108, 110 to a corresponding one of the first or second recuperators 56, 58, while opening the other bidirectional flow port 108, 110 to permit a flow of bleed air from the other one of the recuperators 56, 58 through the bleed air discharge port 92 of the recuperator directional flow control valve 68, and then through the Y-conduit 124 to the exhaust manifolds 14, 16 in the manner described above.

The EGR controller 72 receives output signals from the sensor 74 and, if appropriate, other sensors not shown, to effect changes in the EGR output of the metering valve 70 and thereby produces a desired, and selectable EGR flow rate. The EGR controller 72 includes preprogrammed instructions for processing the output signals from the sensor 74, and other sensors if utilized, generates a valve control signal which is supplied by way of the conductor 100 to the metering valve 70 to effect the desired amount of opening of the metering valve 70 between a closed position and an open position to thereby provide a desired EGR rate. Accordingly, an amount of cooled exhaust gas available for recirculation during exhaust pressure pulses is selectively variable based upon the status of the monitored one or more factors identified above. Due to variations in engine design and EGR component design, the EGR controller 72 can include an empirically determined look-up table which correlates sensor output values to valve position values for controlling a valve position of the metering valve 70. Thus, the present invention provides EGR during exhaust pressure pulses to improve the back pressure to boost pressure gradient of the internal combustion engine 10 without adversely affecting fuel consumption.

In a similar manner, the controller 72 provides a control signal by way of the conductor 126 to the regenerator outlet flow control valve 104 to selectively open the appropriate one of the outflow fluid conduits 11 6, 118 from the first or second particulate traps/stationary recuperators 56, 58, depending upon the directional operational mode of flow of the exhaust gas and bleed air flow through the respective recuperators 56, 58. Likewise, the controller 72 provides a control signal through the conductor 128 to control the respective operation of the bleed air directional flow control valve to direct bleed air through either fluid conduit 120 or 122 to the respective second ends of recuperators 56, 58. The controller 72 also provides a control signal through the conduit 132 to control the respective first and second mode positions of the recuperator directional flow control valve 68.

The piston pumped EGR system embodying the present invention, in which stationary recuperators are used, provides several important operating advantages. Through the above-described arrangement, EGR percentages can be controlled at all operating points, both transient and steady state mode operation. There is a significant cost reduction in the use of stationary regenerators 56, 58 over rotary recuperators and regenerators, which typically require the use of corrosion resistant materials as well as presenting sealing challenges. In the above-described arrangement, EGR cooling is provided across the entire operating range, thereby providing boost cooling even at low loads. The air-to-air aftercooler (ATAAC) 20 provides an additional beneficial cooling of the recirculated exhaust gas as a result of the recirculated exhaust gas being mixed with the compressed intake air prior to introduction to the intake manifold. Particulate matter is removed from the EGR as a result of the particulate traps, either integrally provided with the recuperators 56, 58, or separately associated therewith. Removal of particulate matter not only reduces engine wear, but also reduces the particulate material emitted from the engine. The reverse flow of bleed air through the particulate trap/stationary recuperators 56, 58, during alternate operation reduces clogging as a result of the inherent reverse flow cleaning of the particulate filters that are thus provided in the EGR line.

It should also be noted that while two separate particulate trap/stationary recuperators 56, 58 are illustrated in the illustrated embodiment, it should be realized that a single stationary particulate trap/stationary recuperator having two divided sections could also be used in the same manner as illustrated. Furthermore, the specific control valve and fluid conduit locations and connections between respective components of the illustrated system could be altered to meet different control requirements, if so desired.

Other aspects, objects, and advantages of this invention can be obtained from a study of the drawings, the disclosure, and the appended claims.

What is claimed is:

1. An internal combustion engine, comprising:

a block having at least one combustion chamber defined therein;

an intake manifold in fluid communication with a source of combustion air and said combustion chamber;

a first exhaust manifold fluidly connected to said combustion chamber for transporting exhaust gas therefrom to at least one of a first primary exhaust outlet and a first EGR exhaust outlet;

a first check valve having an inlet and an outlet, said inlet being fluidly coupled to said first EGR exhaust outlet of the first exhaust manifold;

a regenerator directional flow control valve having an inlet port, first and second bidirectional flow ports, and a bleed air discharge port, said inlet port being in fluid communication with the outlet of said check valve; and first and second stationary regenerators, each of said first and second stationary regenerators having a first end and a second end, the first ends of the stationary regenerators being in fluid communication with a respective one of the first and second bidirectional flow ports of the directional flow control valve and the second ends of the stationary regenerators being in selective communication with one of the intake manifold of the engine and said bleed flow line in fluid communication with said intake manifold.

2. The internal combustion engine, as set forth in claim 1, wherein each of said first and second stationary regenerators include a particulate trap.

3. The internal combustion engine, as set forth in claim 1, wherein said engine includes a turbocharger having an intake air compressor, an air-to-air aftercooler having an inlet end and an outlet end, said inlet end of the air-to-air aftercooler being in fluid communication with said compressor and the outlet end of the air-to-air aftercooler being connected to a fluid conduit in communication with the intake manifold of the engine, and said second ends of the first and second stationary regenerators are in selective fluid communication with one of said fluid conduit in communication with the intake manifold and said bleed flow line, said bleed flow line being in fluid communication with said fluid conduit connected to the air-to-air aftercooler.

4. The internal combustion engine, as set forth in claim 3, wherein said engine includes an EGR metering valve disposed between the second ends of the first and second stationary regenerators and the fluid conduit connected to the air-to-air aftercooler and communicating with the intake manifold of the engine.

5. The internal combustion engine as set forth in claim 1, wherein said engine includes a regenerator outlet directional flow control valve in selective communication with the second ends of said first and second stationary regenerators with an EGR metering valve disposed between said regenerator outlet directional flow control valve and said intake manifold of the engine.

6. The internal combustion engine as set forth in claim 1, wherein said engine includes a plurality of combustion chambers and a second exhaust manifold fluidly connected to another one of said plurality of said combustion chambers, said second exhaust manifold having a second primary exhaust outlet and a second EGR exhaust outlet and a second check valve having a second inlet and a second outlet, said second inlet being fluidly coupled to said second EGR exhaust outlet and said second outlet being fluidly coupled to said inlet port of the regenerator directional flow control valve.

7. An EGR system for an internal combustion engine, said internal combustion engine including a block having a plurality of combustion chambers defined therein, an intake manifold in fluid communication with a source of combustion air and said combustion chambers, and a first exhaust manifold fluidly connected to at least one of said plurality of combustion chambers, said first exhaust manifold having a first primary exhaust outlet and a first EGR exhaust outlet, said EGR system comprising:

a first check valve having an inlet and an outlet, said inlet being fluidly connected to said first EGR exhaust outlet of the first exhaust manifold;

a regenerator directional flow control valve having an inlet port, first and second bidirectional flow ports, and a bleed air discharge port, said inlet port being in fluid communication with the outlet of said first check valve and said bleed air discharge port being in fluid communication with said first exhaust manifold; and first and second stationary regenerators, each of said first and second stationary regenerators having a first end and a second end, the first ends of the stationary regenerators being in fluid communication with a respective one of the first and second bidirectional flow ports of the regenerator directional flow control valve, and the second ends of the stationary regenerators being in selective communication with one of the intake manifold of the engine and said bleed flow line in fluid communication with said intake manifold.

8. The EGR system, as set forth in claim 7, wherein each of said first and second stationary regenerators have a particulate trap associated therewith.

9. The EGR system, as set forth in claim 7, wherein said engine includes a turbocharger having a compressor, an air-to-air aftercooler having an inlet end in fluid communication with said compressor, and an outlet end in fluid communication with the intake manifold of said engine, said second ends of the first and second stationary regenerators of said EGR system being in selective fluid communication with the intake manifold of said engine and said bleed flow line in fluid communication with the outlet end of said air-to-air aftercooler.

10. The EGR system, as set forth in claim 9, wherein said system includes an EGR metering valve disposed between the second ends of the first and second stationary regenerators and said intake manifold of the engine.

11. The EGR system, as set forth in claim 10, wherein said EGR system includes a controller coupled to said metering valve to variably position said metering valve between an open position and a closed position whereby said EGR rate is varied.

12. The EGR system, as set forth in claim 11, wherein said EGR system includes a sensor coupled to said controller, said sensor being adapted to monitor a status of at least one of a $CO_2$ content of said exhaust gas, a $NO_x$ content of said exhaust gas, an EGR rate, an engine speed, and an altitude.

13. The EGR system, as set forth in claim 12, wherein said controller variably positions said metering valve between said open position and said closed position to vary said EGR rate in response to an output signal received from said sensor.

14. The EGR system, as set forth in claim 7, wherein said system includes a second exhaust manifold fluidly connected to another at least one of said plurality of said combustion chambers, said second exhaust manifold having a second primary exhaust outlet and a second EGR exhaust outlet; and a second check valve having a second inlet and a second outlet, said second inlet being fluidly coupled to said second EGR exhaust outlet and said second outlet being fluidly coupled to said inlet port of the regenerator directional flow control valve.

15. A method for using an EGR system with an internal combustion engine wherein said engine includes a plurality of combustion chambers, an intake manifold in fluid communication with said combustion chambers, and a first exhaust manifold, and said EGR system includes a first check valve, a regenerator directional flow control valve, and first and second stationary regenerators, said method comprising the steps of:

moving the regenerator directional flow control valve to a first position whereby exhaust gas received from the first check valve is directed to a first end of said first stationary regenerator, cooled during passage through said first stationary regenerator, and subsequently discharged from a second end of said first stationary regenerator to said fluid conduit in communication with said intake manifold, and simultaneously a flow of bleed air is directed from a conduit in fluid communication with said intake manifold to a second end of said second stationary regenerator thereby cooling said second stationary regenerator during passage of the bleed air therethrough, and then discharged from a first end of said secondary stationary regenerator and through the EGR directional flow control valve to said first exhaust manifold; and after a preselected time, subsequently moving said regenerator directional flow control valve to a second position whereby exhaust gas received from said first check valve is directed to the first end of said second stationary regenerator, cooled during passage through said secondary stationary regenerator, and then discharged from the second end of the second stationary regenerator to a conduit in fluid communication with the intake manifold of said engine and simultaneously a flow of bleed air is directed from said conduit in communication with said intake manifold to the second end of said first stationary regenerator, thence through the first stationary regenerator whereupon said first stationary regenerator is cooled during passage of the bleed air therethrough, and then discharged from the first end of said first stationary regenerator through the regenerator directional flow control valve to said first exhaust manifold.

16. The method, as set forth in claim 15, wherein said method includes providing a metering valve between the respective second ends of said first and second stationary regenerators and said intake manifold, and varying an EGR rate of said internal combustion engine in response to a modulation of said metering valve.

17. The method, as set forth in claim 15, wherein said method includes the step of monitoring a status of at least one of a $CO_2$ content of said exhaust gas, a $NO_x$ content of said exhaust gas, an EGR rate, an engine speed, and an altitude.

18. The method, as set forth in claim 17, wherein said EGR rate is varied in response to an outcome of said monitoring step.

19. The method, as set forth in claim 15, wherein said first and second stationary regenerators of the EGR system each have a respective particulate trap associated therewith, and said method includes trapping particulate matter carried in said exhaust gas as said exhaust gas flows from the first end to the second end of said respective stationary regenerators.

20. The method, as set forth in claim 15, wherein said engine includes a second exhaust manifold fluidly connected to at least one of said plurality of combustion chambers, said second exhaust manifold having a second primary exhaust outlet and a second EGR exhaust outlet, and said EGR system having a second check valve having a second inlet and a second outlet, said second inlet being fluidly coupled to said second EGR exhaust outlet of the second exhaust manifold, and said second outlet being coupled to an inlet port of said regenerator directional flow control valve, and said method includes:

moving the regenerator directional flow control valve to a first position whereby exhaust gas received from at least one of said first and second check valves is directed to a first end of said first stationary regenerator, cooled during passage through said first stationary regenerator, and subsequently discharged from a second end of said first stationary regenerator to said fluid conduit in communication with said intake manifold, and simultaneously a flow of bleed air is directed from a conduit in fluid communication with said intake manifold to a second end of said second stationary regenerator thereby cooling said second stationary regenerator during passage of the bleed air therethrough, and then from a first end of said secondary stationary regenerator and through the EGR directional flow control valve to at least one of said first and second exhaust manifolds; and after preselected time, subsequently moving said regenerator directional flow control valve to a second position whereby exhaust gas received from at least one of said first and second check valves is directed to the first end of said second stationary regenerator, cooled during passage through said secondary stationary regenerator, and then discharged from the second end of the second stationary regenerator to a conduit in fluid communication with the intake manifold of said engine, and simultaneously a flow of bleed air is directed from said conduit in communication with said intake manifold to the second end of said first stationary regenerator, thence through the first stationary regenerator whereupon said first stationary regenerator is cooled during passage of the bleed air therethrough and said bleed air is then discharged from the first end of said first stationary regenerator through the generator directional flow control valve to at least one of said first and second exhaust manifolds.

* * * * *